United States Patent [19]

Allen

[11] 4,134,463

[45] Jan. 16, 1979

[54] AIR LIFT SYSTEM FOR LARGE DIAMETER BOREHOLE DRILLING

[75] Inventor: James H. Allen, Lakewood, Calif.

[73] Assignee: Smith International, Inc., Newport Beach, Calif.

[21] Appl. No.: 808,872

[22] Filed: Jun. 22, 1977

[51] Int. Cl.[2] ..... E21C 23/00

[52] U.S. Cl. ..... 175/53; 175/213; 175/324

[58] Field of Search ..... 175/69, 205, 213, 212, 175/324, 217, 215, 100, 53, 72; 417/54, 55, 65, 108, 118, 65

[56] References Cited

U.S. PATENT DOCUMENTS

| | | | |
|---|---|---|---|
| 1,604,644 | 10/1926 | Heyser | 417/108 |
| 1,760,240 | 5/1930 | Loomis | 417/54 |
| 2,062,799 | 12/1936 | Scott | 417/108 |
| 2,537,605 | 1/1951 | Sewell | 175/205 |
| 2,849,213 | 8/1958 | Failing | 175/213 |
| 3,077,358 | 2/1963 | Costa | 175/205 X |
| 3,208,537 | 9/1965 | Scarborough | 175/53 |
| 3,385,382 | 5/1968 | Canalizo et al. | 175/212 X |

*Primary Examiner*—Ernest R. Purser
*Assistant Examiner*—Richard E. Favreau
*Attorney, Agent, or Firm*—Robert M. Vargo

[57] ABSTRACT

An air lift system for large diameter borehole drilling is disclosed. The system is applicable in drilling operations where a vertical pilot hole is drilled below the point to which the borehole will later be enlarged and a slant hole is drilled obliquely to intersect the pilot hole near its nether position. During the drilling operation, the circulation system pumps drilling fluid down the annulus of the borehole to cool the cutterhead and to mix with the cuttings. The drilling fluid carrying the cuttings then moves down the pilot hole and up through the slant hole. A plenum is located in the slant hole to assist in the lifting of the drilling fluid. The plenum includes a tapered transition pipe, a tapered discharge horn, and an air diffusion ring located at the throat of the discharge horn. The diffusion ring is utilized to inject outside air into the drilling fluid passing therethrough. The discharge horn is shaped to enable the discharge velocity of the drilling fluid passing through the discharge horn to be constant over the entire length thereof.

14 Claims, 4 Drawing Figures

AIR LIFT SYSTEM FOR LARGE DIAMETER BOREHOLE DRILLING

BACKGROUND OF THE INVENTION

1. Field of the Invention

The present invention relates generally to the art of drilling large boreholes in earth formations and, more particularly, to the methods of removing the cuttings from the borehole during the drilling operation.

2. Description of the Prior Art

In the drilling of large boreholes in earth formations, a large diameter drill bit is secured to the lower end of a drill stem which is lowered and rotated to cause the bit to operate on the formation being encountered to cut or crush the same. Circulation systems, utilizing drilling fluids such as water or mud, are used to cool and clean the bit and to remove the cuttings produced by the drilling operation from the borehole. Conventional circulation systems pump the drilling fluid downwardly through the drill stem and the fluid returns upwardly through the annulus area between the drill stem and the wall of the hole being drilled. The shortcoming of the conventional circulation systems is that the removal of the cuttings is not efficient in large boreholes because of the large amount of cuttings produced and because the annulus area is much larger than the interior of the drill stem, thereby reducing the return velocity of the drilling fluid and its lifting capacity.

An improved circulation system is described in U.S. Pat. No. 3,208,537 in which an initial small vertical pilot hole extends below the point to which the borehole will later be enlarged and a slant hole is drilled obliquely so that it will intersect the pilot hole near its nether position. The drilling fluid containing the cuttings is then circulated downwardly through the pilot hole and upwardly through the slant hole. An ejector pump is provided in the slant hole to accelerate the upward movement of the drilling fluid therethrough.

The present invention improves on both systems by providing an air lift system for creating a more efficient flow through the drilling fluid return.

SUMMARY OF THE INVENTION

In its broadest aspect, the present invention includes a plenum provided within the return line of the drilling fluid. An air diffusion ring is located at the throat or entryway of the plenum for injecting air into the drilling fluid passing up through the plenum. The plenum is in the form of an expanding chamber to enable the flow velocity of the aerated drilling fluid passing therethrough to be constant as the air bubbles expand due to diminishing pressure.

A primary advantage of the present invention is that the constant discharge velocity of the drilling fluid passing through the plenum is greatly increased, thereby providing a more efficient overall circulation system.

The features of the present invention, which are believed to be novel, are set forth with particularity in the appended Claims. The present invention, both as to its organization and manner of operation, together with the further advantages thereof, may best be understood by reference to the following description taken in connection with the accompanying drawings.

DESCRIPTION OF THE PREFERRED EMBODIMENT

Figure 1:
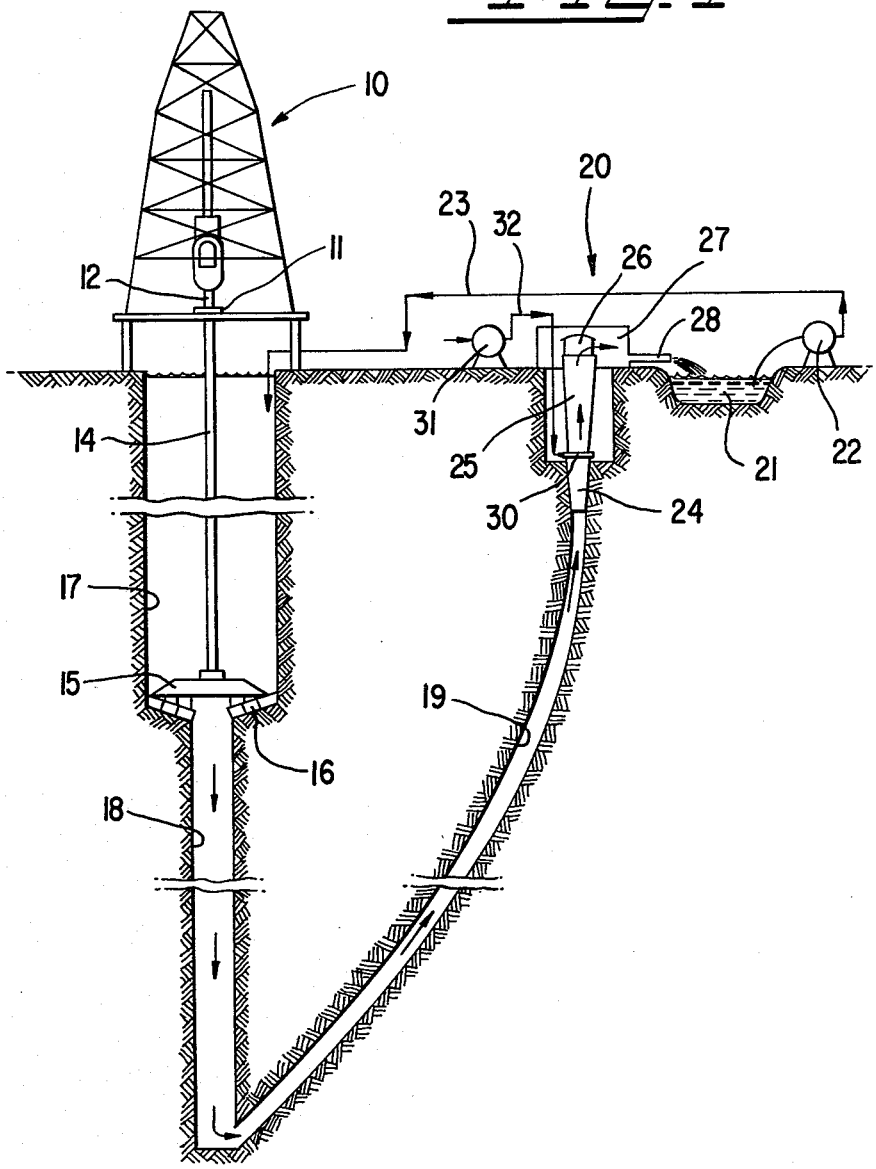
FIG. 1 is a diagrammatic view of a drilling rig and a vertical cross section through an earth formation, illustrating the new and improved circulation system of the present invention.

Referring now to the drawings, FIG. 1 illustrates a drilling rig generally indicated by arrow 10, having a rotary table 11, a drive Kelly 12, and a non-circulating swivel 13.

A drill stem 14 is connected at its upper end to the drive keeley 12 and at its lower end to a large diameter drill bit 15. The drill bit 15 includes a plurality of roller cutters 16 for contacting and disintegrating the earth formation at the bottom of a borehole 17.

A small diameter vertical pilot hole 18, having been previously drilled with a small diameter bit attached to the drill stem, extends below the point to which the borehole 17 is to be enlarged. A slant hole 19 is drilled obliquely so that it will intersect the pilot hole 18 near its nether position.

An air lift system generally indicated by arrow 20 is provided to circulate drilling fluid such as water or mud through the borehole 17 to cool the dril bit 15 and mix with the cuttings generated at the face of the borehole 17. The air lift system 20 includes a reservoir 21 for storing the drilling fluid adjacent the rig 10.

A pump 22 is provided to pump the drilling fluid from the reservoir 21 through a fluid line 23 to the annulus of the borehole 17.

As shown in FIG. 1, the drilling fluid completely fills the annulus of the borehole 17 and is drawn downwardly past the drill bit 15 to mix with the cuttings generated thereby. The drilling fluid is then drawn down through the pilot hole 18 and up through the slant hole 19, transporting with it the cuttings from the face of the borehole 17.

Figure 2:
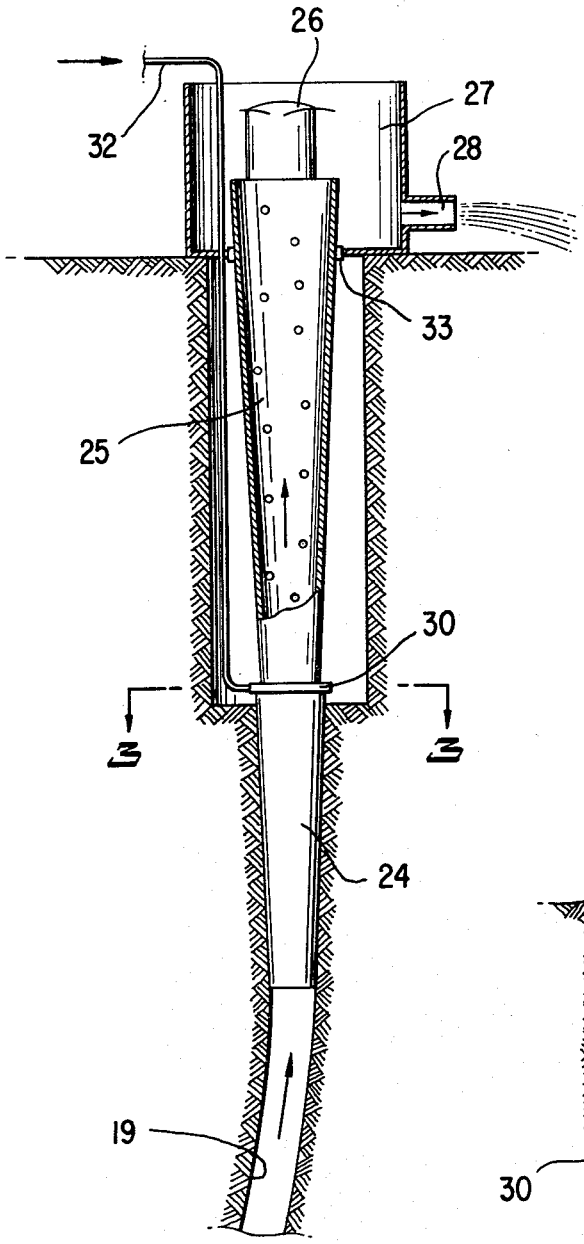
FIG. 2 is an enlarged fragmentary view of the plenum and air diffusion ring of the present invention.

As shown in FIGS. 1 and 2, the air lift system further includes a plenum comprising a tapered transition pipe 24 located near the top of the slant hole 19, which communicates with the throat of a tapered discharge horn 25. A bonnet 26 is positioned over the discharge horn 25 and is located within a chamber 27 having a discharge pipe 28 feeding into the reservoir 21.

An air diffusion ring 30 is positioned at the throat of the discharge horn 25 to inject air into the drilling fluid passing therethrough. An air pump 31 is provided to inject outside air into the air diffusion ring 30 via an air conduit 32.

The tapered discharge horn 25 can be in the shape of a hyperboloid of one sheet or a shape similar to that of the end of a bugle or trumpet. The shape of the discharge horn 25 is such that the velocity of the drilling fluid passing therethrough is constant over the entire length thereof.

A seal plate 33 is positioned around the discharge horn 25 adjacent the top end thereof to cap the top of the slant hole 19.

Figure 3:
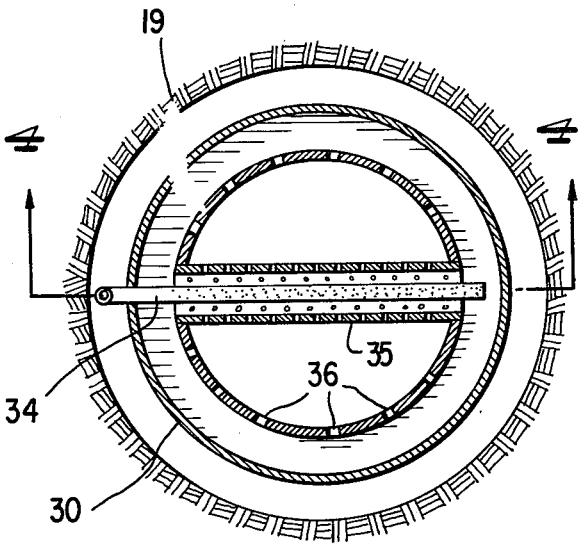
FIG. 3 is a sectional view of the diffusion ring taken along lines 3—3 of FIG. 2.
Figure 4:
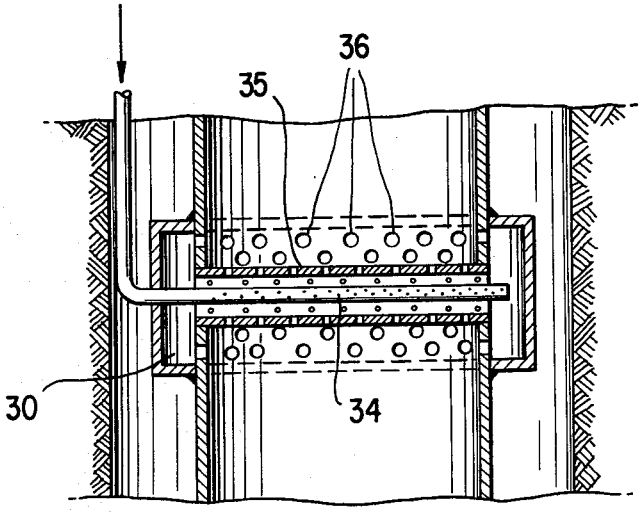
FIG. 4 is a vertical section view of the diffusion ring taken along lines 4—4 of FIG. 3.

As shown in FIGS. 3 and 4, the air diffusion ring 30 comprises a ported tube 34 connected to the end of the air conduit 32 and extending across the throat of the tapered discharge horn 25. A porous ceramic member 35 extends around the tube 34 to enable the air existing from the tube 34 to disperse therethrough into the central portion of the discharge horn 25.

The annular diffusion ring 30 extends around the discharge horn 25 with the interior thereof communicating with the tube 34. The wall portion of the discharge horn 25, located within the annular ring 30, includes a plurality of ports 36 for allowing air to enter the peripheral portion of the discharge horn 25 to mix with the drilling fluid passing therethrough.

OPERATION

Referring again to FIG. 1, the borehole 18 may, for example, be drilled with a 72 inch diameter bit in the usual manner to a depth of approximately 500 feet. The slant hole 19, for example, may be drilled with a 28 inch diameter bit in a direction so as to intersect the pilot hole 18 at approximately the 500 foot level. The drill bit 15 which may be from 10 to 30 feet in diameter is then secured to the drill stem 14 in order to enlarge the pilot hole 18 to the desired diameter and depth. The drill bit 15 is rotated by the rotary table 11 driving the kelley 12 and drill stem 14. As the borehole 17 is being enlarged to the desired depth by the drill bit 15, the drilling fluid and the cuttings produced by such enlargement may pass downwardly into the pilot hole 18 and upwardly through the slant hole 19. Upon reaching the top of the slant hole 19 the drilling fluid containing the cuttings passes through the plenum formed by the transition pipe 24 and the discharge horn 25. Upon passing through the throat of the horn 25, the drilling fluid is air lifted (made lighter) by the air injected through the diffusion ring 30. The air mixing with this drilling fluid increases the velocity of the drilling fluid passing through the throat of the discharge horn 25. As the drilling fluid progresses upwardly through the discharge horn 25, the flow velocity remains constant because of the tapered shape of the discharge horn 25. Upon exiting through the bonnet 26 into the chamber 27 the drilling fluid is discharged through the pipe 28 back into the reservoir 21.

Various operations such as shale shaking, degassing, etc. (not shown) are performed on the drilling fluid before it is recirculated via the pump 22 back into the annulus of the borehole 17.

It should be noted that the design of the diffusion ring 30 enables air to enter the peripheral and central areas of the drilling fluid flow to ensure that the entire stream of drilling fluid has been injected with air.

Simple air lift systems have an efficiency between 38 and 45 percent. The efficiency of the present invention can be as high as 60 to 65 percent because of: (1) the outside air injection system; and (2) the velocity and friction heads being at a minimum. The minimum velocity and friction heads are due to the constant velocity of the drilling fluid through the discharge horn 25.

The rotary air pump 31 can operate at a low pressure and such high volume low pressure blowers are less expensive than higher pressure lower volume air compressors.

Moreover, because of the present invention, an 18 inch ID circulation swivel can be eliminated on the drilling rig. Such swivels and hose are very expensive. Instead, a less expensive non-circulation swivel can be utilized for such big hole boring. In fact, the estimated cost savings for the simple swivel will more than off-set the cost of drilling a pilot hole and a slant hole. As a result, a new and improved circulation system can now be utilized in large diameter borehole drilling which can operate on less horsepower and enable the system to drill at a faster penetration rate.

It should be noted that various modifications can be made to the assembly while still remaining within the purview of the following claims. It should also be noted that although the air lift system of the present invention has been described in the preferred embodiment, utilizing a pilot hole and a slant hole return line, the present invention could also be utilized in a well having a reverse circulation system in which the drilling fluid is returned up through the drill stem.

What is claimed is:

1. In a large diameter borehole having an annulus area between the drill stem and the wall of the borehole through which drilling fluid is transported to the borehole bottom and a return passageway for the drilling fluid returning from the borehole bottom, an air lift system comprising:

plenum means, located in said return passageway, having an expanding chamber through which the drilling fluid passes, said plenum means comprising a conduit having a tapered horn shape with a throat located at its lower end forming the entrance; and means, located at the entrance of said plenum means, for diffusing gas into the drilling fluid passing through said plenum means, the plenum means chamber expanding in the direction of fluid flow for enabling the flow velocity of the diffused drilling fluid passing therethrough to be constant, said diffusion means comprising an apertured tube extending across the throat of said tapered conduit, said apertured tube being connected to the discharge of an air pump.

2. The combination of claim 1 wherein said air pump is a high volume, low pressure air blower.

3. The combination of claim 1 wherein said plenum means further comprises a second tapered conduit located in said return passageway immediately below the first tapered conduit.

4. The combination of claim 3 wherein said second tapered conduit opens into the throat of said first tapered conduit.

5. In a large diameter borehole having an annulus area between the drill stem and the wall of the borehole through which drilling fluid is transported downwardly therethrough, said borehole further having a pilot hole extending vertically downwardly below the point to which the borehole is to be enlarged and a slant hole extending obliquely downwardly intersecting the pilot hole near the nether portions thereof, said pilot hole and slant hole forming the return passageway for the drilling fluid, an air lift system comprising:

plenum means, located in said slant hole, having an expanding chamber through which the drilling fluid passes, said plenum means comprising a conduit having a tapered horn shape with a throat located at its lower end forming the entrance; and means, located at the entrance of said plenum means, for diffusing gas into the drilling fluid passing through said plenum means, the plenum means chamber expanding in the direction of fluid flow for enabling the flow velocity of the diffused drilling fluid passing therethrough to be constant, said diffusing means comprising an apertured tube extending across the throat of said apertured tube being connected to the discharge of an air pump.

6. The combination of claim 5 wherein said air pump is a high volume, low pressure air blower.

7. The combination of claim 5 wherein said plenum means further comprises a second tapered conduit located in said slant hole immediately below the first tapered conduit.

8. The combination of claim 5 wherein said second tapered conduit opens into the throat of said first tapered conduit.

9. In a large diameter borehole having an annulus area between the drill stem and the wall of the borehole through which drilling fluid is transported downwardly therethrough, said borehole further having a pilot hole extending vertically downwardly below the point to which the borehole is to be enlarged and a slant hole extending obliquely downwardly intersecting the pilot hole near the nether portions thereof, said pilot hole and slant hole forming the return passageway for the drilling fluid, an air lift system comprising:

plenum means, located in said slant hole, having an expanding chamber through which the drilling fluid passes, said plenum means comprising a conduit having a tapered horn shape with a throat located at its lower end forming the entrance; and means, located at the entrance of said plenum means, for diffusing gas into the drilling fluid passing through said plenum means, the plenum means chamber expanding in the direction of fluid flow for enabling the flow velocity of the diffused drilling fluid passing therethrough to be constant, said diffusing means comprising a porous ceramic tube extending across the throat of said tapered conduit, said ceramic tube being in fluid communication with the discharge of an air pump.

10. The combination of claim 9 wherein said air pump is a high volume, low pressure air blower.

11. In a large diameter borehole having an annulus area between the drill stem and the wall of the borehole through which drilling fluid is transported to the borehole bottom and a return passageway for the drilling fluid returning from the borehole bottom, an air lift system comprising:

plenum means, located in said return passageway, having an expanding chamber through which the drilling fluid passes, said plenum means comprising a conduit having a tapered horn shape with a throat located at its lower end forming the entrance; and means, located at the entrance of said plenum means, for diffusing gas into the drilling fluid passing through said plenum means, the plenum means chamber expanding in the direction of fluid flow for enabling the flow velocity of the diffused drilling fluid passing therethrough to be constant, said diffusing means comprising a porous ceramic tube extending across the throat of said tapered conduit, said ceramic tube being in fluid communication with the discharge of an air pump.

12. The combination of claim 11 wherein said air pump is a high volume, low pressure air blower.

13. In a large diameter borehole having an annulus area between the drill stem and the wall of the borehole through which drilling fluid is transported to the borehole bottom and a return passageway for drilling fluid returning from the borehole bottom, an air lift system comprising:

plenum means, located in said return passageway, having an expanding chamber through which the drilling fluid passes, said plenum means comprising a conduit having a tapered horn shape with a throat located at its lower end forming the entrance; and means, located at the entrance of said plenum means, for diffusing gas into the drilling fluid passing through said plenum means, the plenum means chamber expanding in the direction of fluid flow for enabling the flow velocity of the diffused drilling fluid passing therethrough to be constant, said diffusing means comprising an annular ring extending around the exterior of the throat of said tapered conduit, the surface of said conduit contiguous to said ring having a plurality of ports extending therethrough to provide fluid communication of the interior of the annular ring with the interior of said conduit, said annular ring being in fluid communication with the discharge of an air pump.

14. In a large diameter borehole having an annulus area between the drill stem and the wall of the borehole through which drilling fluid is transported downwardly therethrough, said borehole further having a pilot hole extending vertically downwardly below the point to which the borehole is to be enlarged and a slant hole extending obliquely downwardly intersecting the pilot hole near the nether portions thereof, said pilot hole and slant hole forming the return passageway for the drilling fluid, an air lift system comprising:

plenum means, located in said slant hole, having an expanding chamber through which the drilling fluid passes, said plenum means comprising a conduit having a tapered horn shape with a throat located at its lower end forming the entrance; and means, located at the entrance of said plenum means, for diffusing gas into the drilling fluid passing through said plenum means, the plenum means chamber expanding in the direction of fluid flow for enabling the flow velocity of the diffused drilling fluid passing therethrough to be constant, said diffusing means comprising an annular ring extending around the exterior of the throat of said tapered conduit, the surface of said conduit contiguous to said ring having a plurality of ports extending therethrough to provide fluid communication of the interior of the annular ring with the interior of said conduit, said annular ring being in fluid communication with the discharge of an air pump.

* * * * *